US006914373B2

(12) United States Patent
Itoh et al.

(10) Patent No.: US 6,914,373 B2
(45) Date of Patent: Jul. 5, 2005

(54) ELECTRON LENS AND STRUCTURE FOR A COLD CATHODE OF A CATHODE RAY TUBE

(75) Inventors: Takashi Itoh, Amagasaki (JP); Masahide Yamauchi, Kyoto (JP); Koji Fujii, Kashihara (JP); Keisuke Koga, Souraku-gun (JP); Toru Kawase, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/185,794

(22) Filed: Jun. 27, 2002

(65) Prior Publication Data

US 2003/0006687 A1 Jan. 9, 2003

(30) Foreign Application Priority Data

Jul. 5, 2001 (JP) ..... 2001-205211

(51) Int. Cl.[7] ..... H01J 1/02; H01J 29/70

(52) U.S. Cl. ..... 313/309; 313/336

(58) Field of Search ..... 313/495, 307–309, 313/336, 361, 355, 351, 409; 315/169.1, 169.3

(56) References Cited

U.S. PATENT DOCUMENTS 5,514,847 A * 5/1996 Makishima et al. ... 219/121.12
5,734,223 A * 3/1998 Makishima et al. ..... 313/495
5,850,120 A * 12/1998 Okamoto ..... 313/336
5,877,594 A * 3/1999 Miyano et al. ..... 315/169.1
5,894,187 A * 4/1999 Tomihari ..... 313/309
5,929,557 A * 7/1999 Makishima et al. ..... 313/309
5,977,696 A * 11/1999 Okamoto ..... 313/309
6,121,725 A * 9/2000 Grand-Clement et al. .. 313/497
6,236,156 B1 * 5/2001 Ito ..... 313/495
6,307,309 B1 * 10/2001 Okamoto et al. ..... 313/309

FOREIGN PATENT DOCUMENTS

EP 0 989 580 A2 3/2000
JP 9-283009 A 10/1997
JP 2000-76987 A 3/2000

* cited by examiner

*Primary Examiner*—Joseph Williams
*Assistant Examiner*—Dalei Dong
(74) *Attorney, Agent, or Firm*—Hamre, Schumann, Mueller & Larson, P.C.

(57) ABSTRACT

A cathode ray tube according to the present invention include a cold cathode electron gun, the cold cathode electron gun including a cold cathode array for emitting electrons through field emission, a gate electrode for controlling the field emission, a first selective electrode provided around the cold cathode array and the gate electrode, and a second selective electrode opposing the first selective electrode, and the second selective electrode is adapted to have a lower potential than the gate electrode and the first selective electrode. In accordance with this configuration, the divergence of electron beams emitted from any positions in the cold cathode array can be converged uniformly upon removing electron beams emitted at a great emission angle. This allows the electron beams thereafter to be made narrower by an electrostatic lens. As a result, the present invention can provide a cathode ray tube capable of forming a high-resolution image.

3 Claims, 4 Drawing Sheets

ELECTRON LENS AND STRUCTURE FOR A COLD CATHODE OF A CATHODE RAY TUBE

BACKGROUND OF THE INVENTION

1. Field of the Invention

The present invention relates to a cathode ray tube having a cold cathode electron gun.

2. Description of the Related Art

A cold cathode known as the Spindt type includes a conical emitter and a gate electrode having a gate aperture provided so as to surround the tip of the emitter. By applying a voltage ranging from several tens to 100 V, a strong electric field is generated at the tip of the conical emitter and electrons are emitted from the tip of the emitter.

Whereas electrons emitted from a hot cathode have an initial velocity corresponding to their thermal energy (i.e., not more than a few eV), electrons emitted from the cold cathode have an initial velocity of several tens to 100 eV, corresponding to the difference in applied voltage between the emitter and the gate electrode.

Further, since electrons are emitted not only from the tip of the emitter but also from minute projections formed on the surface of the emitter, some electrons are emitted at a certain angle with respect to a central axis of the conical emitter. The angle at which an electron is emitted with respect to the central axis of the conical emitter is referred to as an "emission angle". Although the emission angle varies depending on the shape and the potential of the emitter and the gate electrode, it generally is known that the emission angle is about 30°. In contrast, in the hot cathode, electrons are emitted at an emission angle of 90°.

Therefore, in the cold cathode, an electron beam is emitted at an initial velocity ranging from several tens to 100 eV and at an emission angle of about 30°. The initial velocity of an electron beam in the cold cathode is several tens of times greater than that in the case of the hot cathode (in which an electron beam is emitted at an initial velocity of a few eV and at an emission angle of 90°). Therefore, when the cold cathode is used as a cathode of an electron gun in a cathode ray tube, an electron beam emitted from the emitter has a certain divergence angle when entering an electrostatic lens region of the electron gun. The electron beam having such a divergence angle cannot be made narrower easily by the electrostatic lens to be encountered later. As a result, a small beam spot cannot be formed on a phosphor screen, which causes a decrease in resolution of a display image.

As a solution to this problem, JP 9(1997)-283009 A discloses a method for reducing the divergence of an electron beam. In the following, this method will be described with reference to FIGS. 6 and 7. In FIGS. 6 and 7, 1*a* denotes conical emitters and 2 denotes a gate electrode having openings (gate apertures) surrounding the respective emitters 1*a*.

In FIG. 6, the region where the emitters 1*a* are formed and the gate electrode 2 are circular, and a first focus electrode 13 is disposed on the outside of them so as to be coplanar with the gate electrode 2. To the first focus electrode 13, a potential lower than that of the gate electrode 2 is applied. By providing the first focus electrode 13 having a lower potential than that of the gate electrode 2 on the outside of the region where the emitters 1*a* are formed, a focus effect acts on an electron beam from the outside, thereby reducing the divergence of the electron beam.

On the other hand, in FIG. 7, the region where the emitters 1*a* are formed and the gate electrode 2 are in a ring shape, and a first focus electrode 13 and a second focus electrode 14 are disposed on the outside and the inside of them, respectively, so as to be coplanar with the gate electrode 2. To the first focus electrode 13 and the second focus electrode 14, a potential lower than that of the gate electrode 2 is applied. By providing the first focus electrode 13 and the second focus electrode 14, each having a lower potential than that of the gate electrode 2, on the outside and the inside of the region where the emitters 1*a* are formed, a convergence effect acts on an electron beam from the outside and the inside, thereby reducing the divergence of the electron beam.

However, in the case where the circular region with the emitters 1*a* shown in FIG. 6 has a greater diameter, and in the case where the ring-shaped region with the emitters 1*a* shown in FIG. 7 has a greater width in its radial direction, electron beams emitted from the emitters 1*a* in the vicinity of the first focus electrode 13 or second focus electrode 14 and those emitted from the emitter 1*a* apart from these electrodes are subjected to different degrees of convergence effect and thus have different degrees of divergence. That is, according to the technique shown in FIGS. 6 and 7, although the divergence of the electron beams emitted from the emitters 1*a* in the vicinity of the first focus electrode 13 or the second focus electrode 14 can be reduced, the divergence of the electron beams emitted from the emitter 1*a* apart from these electrodes cannot be reduced sufficiently.

SUMMARY OF THE INVENTION

Therefore, with the foregoing in mind, it is an object of the present invention to provide a cathode ray tube having an electron gun provided with a cold cathode array, capable of converging the divergence of electron beams emitted from any positions in the cold cathode array uniformly, thus allowing a high-resolution image to be formed.

In order to achieve the above-mentioned object, a cathode ray tube according to the present invention includes a cold cathode electron gun, the cold cathode electron gun including a cold cathode array for emitting electrons through field emission, a gate electrode for controlling the field emission, a first selective electrode provided around the cold cathode array and the gate electrode, and a second selective electrode opposing the first selective electrode, wherein the second selective electrode has a lower potential than the gate electrode and the first selective electrode.

In a cathode ray tube according to the present invention, the divergence of electron beams emitted from any positions in the cold cathode array can be converged uniformly upon removing electron beams emitted at a great emission angle, which allows the electron beams thereafter to be made narrower by electrostatic lenses. Therefore, the present invention can provide a cathode ray tube capable of forming a high-resolution image.

These and other advantages of the present invention will become apparent to those skilled in the art upon reading and understanding the following detailed description with reference to the accompanying figures.

DETAILED DESCRIPTION OF THE INVENTION

Hereinafter, an embodiment of the present invention will be described with reference to the accompanying drawings.

Figure 2:
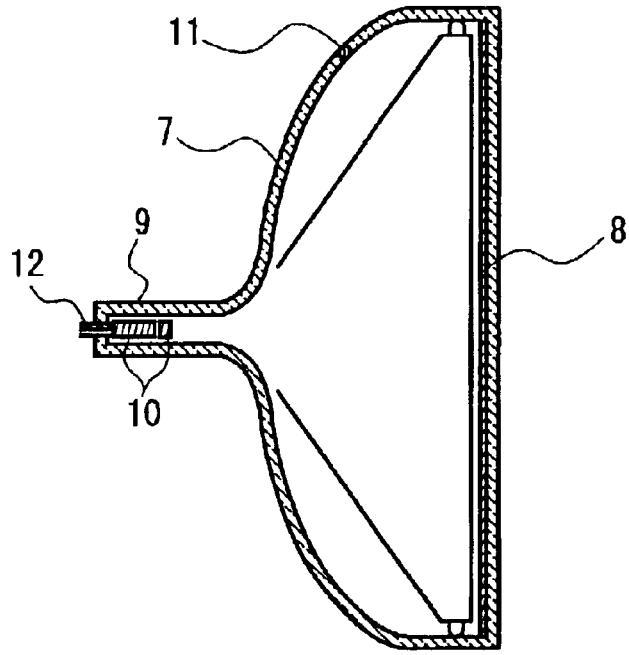
FIG. 2 is a cross-sectional view showing a schematic structure of a cathode ray tube according to the present invention.

As shown in FIG. 2, a cathode ray tube according to an embodiment of the present invention includes a glass bulb 7, a phosphor screen 8 formed on the inside face of a screen of the glass bulb 7, and a cold cathode electron gun 10 contained in a neck portion 9 of the glass bulb 7.

Figure 1:
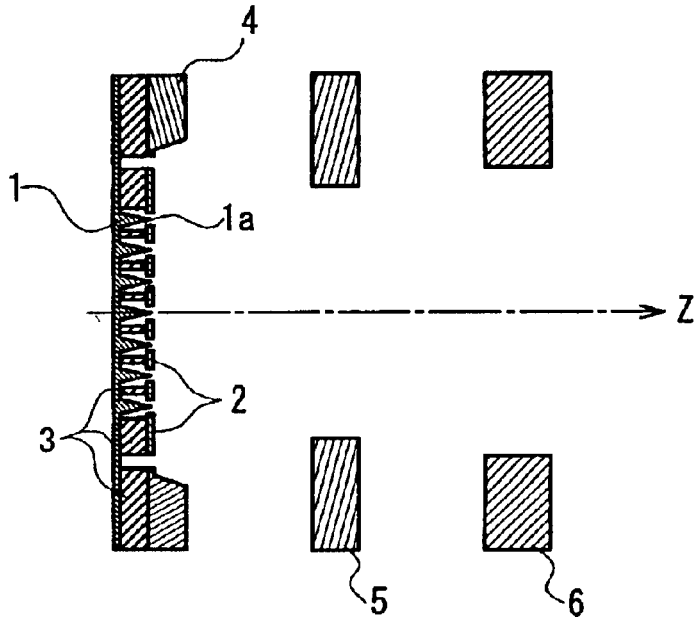
FIG. 1 is a cross-sectional view showing a schematic structure of an electron gun to be mounted on a cathode ray tube according to the present invention in the vicinity of a cold cathode array.

As shown in FIG. 1, the cold cathode electron gun 10 includes a cold cathode array 1 on which a plurality of emitters 1*a* for emitting electron through field emission are formed, a gate electrode 2 for controlling the field emission, a first selective electrode 4 surrounding the cold cathode array 1 and the gate electrode 2, a second selective electrode 5 opposing the first selective electrode 4 on the side closer to the screen, and a beam shaping electrode 6 opposing the second selective electrode 5 on the side closer to the screen. The cold cathode electron gun 10 further includes a focusing electrode and a final accelerating electrode (they are not shown in the drawing), which form a main lens portion, on the side closer to the screen with respect to the beam shaping electrode 6.

The plurality of emitters 1*a*, each having a conical shape, are arranged on a substrate at predetermined intervals. Further, insulators 3 having a predetermined thickness are formed on the substrate so as to surround the respective emitters 1*a*, and the gate electrode 2 having openings corresponding to the respective emitters 1*a* is formed on the insulators 3. The first selective electrode 4 is formed on the insulators 3 that are formed on the outside of the region where the emitters 1*a* are formed.

To the final accelerating electrode, a high voltage of about 25 kV to 35 kV is applied from an anode button 11, which is provided on the outer wall of the glass bulb 7, via the surface of the inner wall of the glass bulb 7. To the electrodes other than the final accelerating electrode, any desired voltages are applied from a stem portion 12. Among these, to the focusing electrode, a voltage of about 5 kV to 8 kV is applied.

To the gate electrode 2, a voltage whose potential is higher than that of the emitters 1*a* by the voltage (gate voltage) Vex is applied. By adjusting the gate voltage Vex, the field emission of electrons from the emitters 1*a* can be controlled. Further, a voltage whose potential is higher than that of the emitters 1*a* by the voltage Vs1 is applied to the first selective electrode 4 and a voltage whose potential is higher than that of the emitters 1*a* by the voltage Vs2 is applied to the second selective electrode 5. The gate voltage Vex and the voltage Vs2 (hereinafter, merely referred to as "the voltage of the second selective electrode") are adapted so as to satisfy the relationship Vs2<Vex, and the voltage Vs1 (hereinafter, merely referred to as "the voltage of the first selective electrode") and the voltage Vs2 are adapted so as to satisfy the relationship Vs2<Vs1.

Since the voltage Vs2 of the second selective electrode 5 is lower than the voltage (gate voltage) Vex of the gate electrode 2 and the voltage Vs1 of the first selective electrode 4 as described above, electrons immediately after being emitted from the cold cathode array 1 are subjected to a force in the negative direction of the Z-axis (the Z-axis is parallel to the tube axis, and the direction toward the phosphor screen 8 is regarded as the positive direction) in a region between the gate electrode 2 and the second selective electrode 5.

Figure 3:
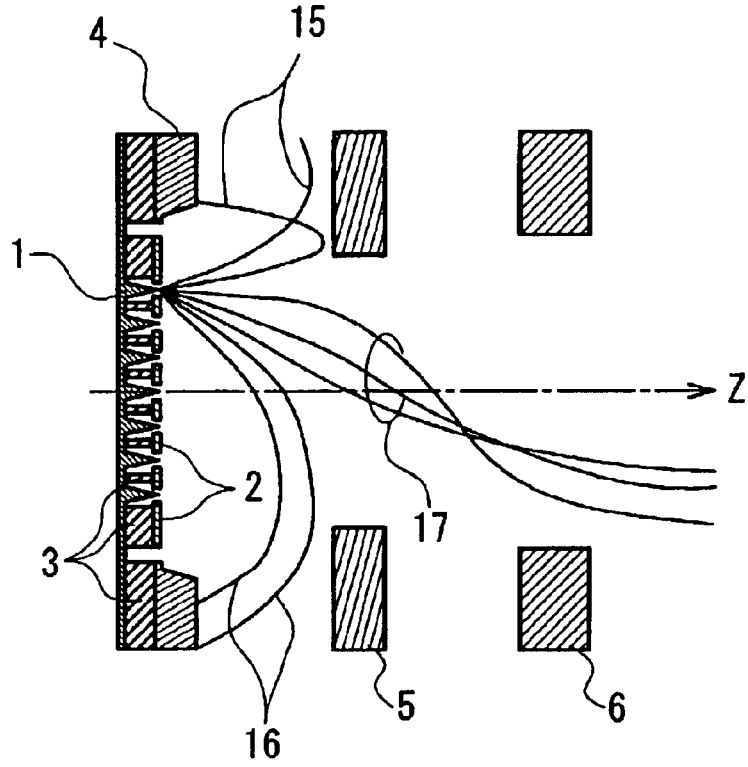
FIG. 3 is a cross-sectional view schematically showing tracks of electrons emitted from a peripheral portion of a cold cathode array according to the present invention.

In FIG. 3, behaviors of electrons emitted from a peripheral portion of the cold cathode array 1 are shown.

An electron 15 emitted outwardly at a great emission angle travels toward a space between the first selective electrode 4 and the second selective electrode 5. However, since the voltage Vs2 of the second selective electrode 5 is lower than the gate voltage Vex and the voltage Vs1 of the first selective electrode 4, the electron 15 travels while losing its velocity component in the Z-axis direction. After the velocity component in the Z-axis direction has gone, the electron 15 gains a velocity component in the negative direction of the Z-axis in accordance with the electrical field generated between the first selective electrode 4 and the second selective electrode 5 so as to impinge finally on the first selective electrode 4 having a higher potential.

Further, an electron 16 emitted inwardly at a great emission angle travels toward the opening of the second selective electrode 5. However, the electron 16 cannot pass through the opening of the second selective electrode 5 since it travels while losing its velocity component in the Z-axis direction similarly to the above-mentioned electron 15 emitted outwardly. The electron 16 travels in accordance with the electrical field generated between the first selective electrode 4 and the second selective electrode 5 so as to impinge finally on the first selective electrode 4 having a higher potential.

What causes these behaviors is the fact that the velocity component in the Z-axis direction of electrons immediately after being emitted is smaller as an emission angle at which they are emitted becomes greater and that the force in the negative direction of the Z-axis strongly acts on electrons especially around the first selective electrode 4 due to the electric fields generated by the gate electrode 2, the first selective electrode 4, and the second selective electrode 5.

On the other hand, an electron 17 emitted from the peripheral portion of the cold cathode array 1 at a small emission angle can pass through the opening of the second selective electrode 5 since it travels toward the opening immediately after it has been emitted and has a sufficiently large velocity component in the Z-axis direction.

Figure 4:
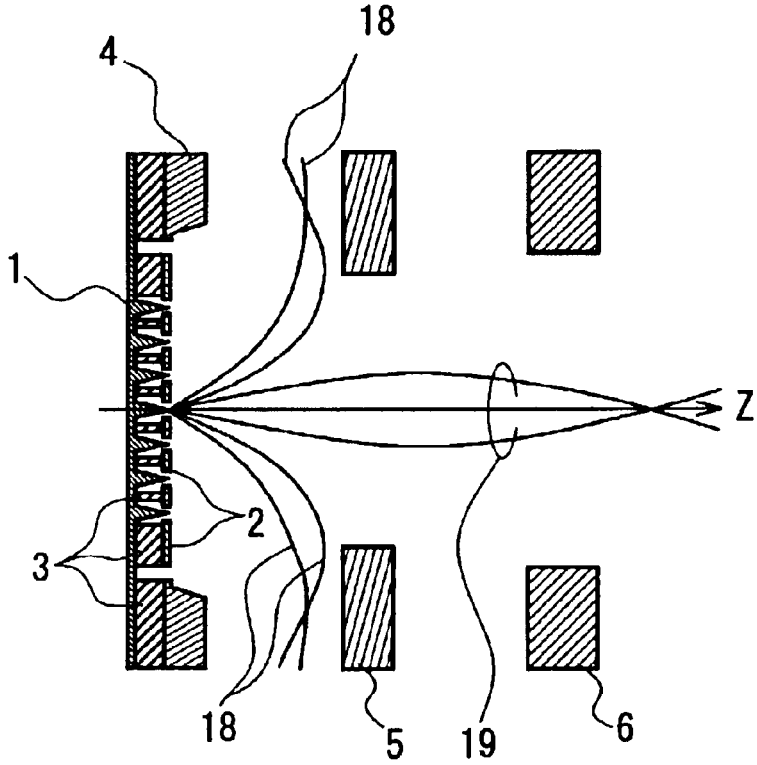
FIG. 4 is a cross-sectional view schematically showing tracks of electrons emitted from a central portion of a cold cathode array according to the present invention.

Next, behaviors of electrons emitted from a central portion of the cold cathode array 1 are shown in FIG. 4.

An electron 18 emitted outwardly at a great emission angle travels toward the space between the first selective electrode 4 and the second selective electrode 5 while losing its velocity component in the Z-axis direction. The electron 18 travels in accordance with the electrical field formed between the first selective electrode 4 and the second selective electrode 5 so as to impinge finally on the first selective electrode 4 having a higher potential.

On the other hand, an electron 19 emitted from the central portion of the cold cathode array 1 at a small emission angle can pass through the opening of the second selective electrode 5 since it travels toward the opening immediately after it has been emitted and has a sufficiently large velocity component in the Z-axis direction.

As described above, only electron beams emitted at a great emission angle are absorbed in the first selective electrode 4 and only electron beams emitted at a small emission angle can pass through the opening of the second selective electrode 5, regardless of whether they are emitted from the peripheral portion or the central portion of the cold cathode array 1. Therefore, the present invention can provide a cathode ray tube having a cold cathode electron gun capable of converging the divergence of electron beams emitted from any positions in the cold cathode array 1 uniformly, despite the fact that the region where the cold cathode array 1 is formed is circular and has a large area. Thus, formation of a high-resolution image becomes possible.

Figure 5:
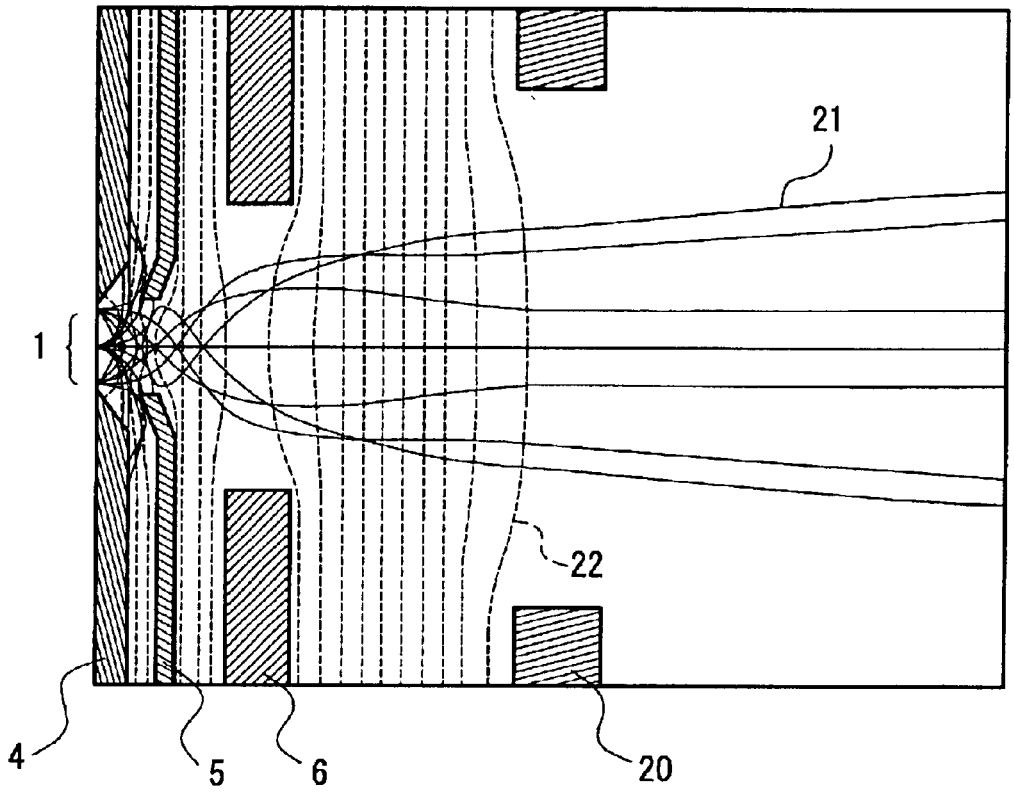
FIG. 5 is a view showing the result of calculation carried out using electric potential distribution in the vicinity of a cold cathode array in a cathode ray tube according to the present invention and tracks of emitted electron beams.
Figure 6:
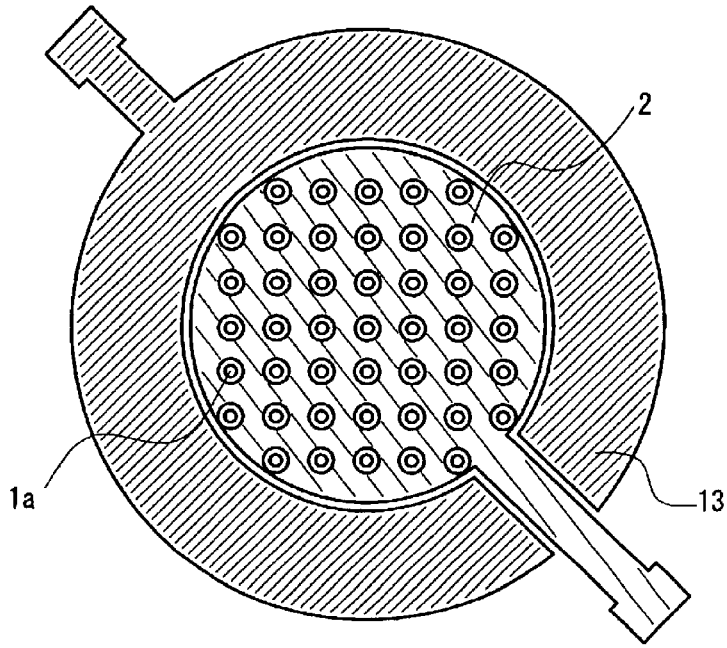
FIG. 6 PRIOR ART
FIG. 6 is a front view showing a conventional cold cathode array having a circular shape.
Figure 7:
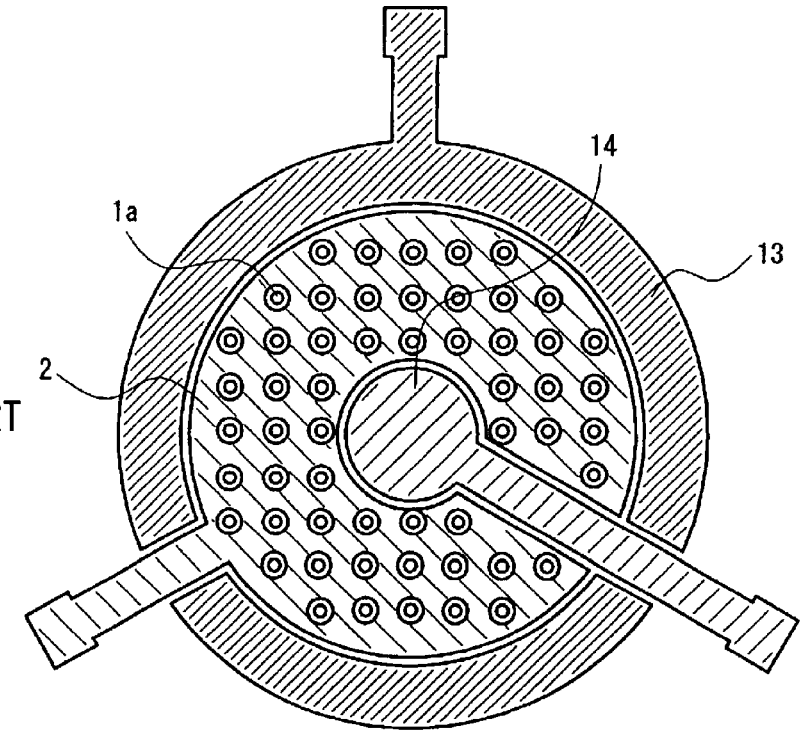
FIG. 7 PRIOR ART
FIG. 7 is a front view showing a conventional cold cathode array having a ring shape.

The following is an example of a calculation result according to an embodiment of the present invention. Tracks of electrons were simulated with regard to the case where the electrons were emitted, as initial conditions, at an initial velocity of 95 eV and at an emission angle varying from −30° to 30° (the divergence angle=60°) in 10° steps into the electric field generated under the following conditions: a gate voltage Vex=95 V; a voltage Vs1 of the first selective electrode 4=40 V; a voltage Vs2 of the second selective electrode 5=50 V; and a voltage of 425 V being applied to the beam shaping electrode 6. The result is shown in FIG. 5. In FIG. 5, 20 denotes the focusing electrode, solid lines 21 denote tracks of the electron beams, and dotted lines 22 denote equipotential lines. As can be seen from FIG. 5, electron beams emitted at emission angles ranging from −15° to 15° pass through the opening of the second selective electrode 5, regardless of whether they are emitted from the peripheral portion or the central portion of the cold cathode array 1. These electron beams are accelerated and shaped by the beam shaping electrode 6 so that the directions of their tracks are made approximately uniform and then enter the main lens portion formed by the focusing electrode 20 and the final accelerating electrode (not shown). On the other hand, electron beams emitted at emission angles greater than ±15° cannot pass the opening of the second selective electrode 5, regardless of the positions in the cold cathode array 1 from which they are emitted. Therefore, the main lens formed by the focusing electrode 20 and the final accelerating electrode (not shown) can make the incident electron beams narrower, thus forming a small beam spot on the phosphor screen.

In the above-mentioned embodiment, the first selective electrode 4 provided around the gate electrode 2 is formed so that the position of its surface in the Z-axis direction is offset in the positive direction of the Z-axis direction from that of the surface of the gate electrode 2 in the Z-axis. However, it is to be noted that the surface of the first selective electrode 4 may be formed so as to be approximately coplanar with the surface of the gate electrode 2.

Further, it is to be noted that the shape of the first selective electrode 4 and second selective electrode 5 may be changed appropriately depending on a state of electron beams emitted from the cold cathode array 1.

Furthermore, it is to be noted that a plurality of cold cathode electron guns according to the present invention, e.g., three cold cathode electron guns corresponding to red, green, and blue, respectively, may be used to provide a color cathode ray tube.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A cathode ray tube comprising a cold cathode electron gun, the cold cathode electron gun comprising:

a cold cathode array including a plurality of emitters for emitting electrons through field emission;

a gate electrode for controlling the field emission;

a first selective electrode provided around the cold cathode array and the gate electrode; and a second selective electrode opposing the first selective electrode on a side closer to a screen with respect to the first selective electrode, wherein the second selective electrode has a lower potential than the gate electrode and the first selective electrode.

2. The cathode ray tube according to claim 1, wherein the second selective electrode is spaced away from the gate electrode and the first selective electrode by an open gap, through which electron travel is possible.

3. The cathode ray tube according to claim 1, wherein the second selective electrode comprises a single opening that corresponds to the plurality of emitters.

* * * * *